US011685637B2

(12) United States Patent
Christensen

(10) Patent No.: US 11,685,637 B2
(45) Date of Patent: Jun. 27, 2023

(54) CRANE SYSTEM FOR A CANTILEVER

(71) Applicant: FUTURE PRODUCTION AS, Kristiansand (NO)

(72) Inventor: Øystein Christensen, Kristiansand (NO)

(73) Assignee: FUTURE PRODUCTION AS, Kristiansand (NO)

( * ) Notice: Subject to any disclaimer, the term of this patent is extended or adjusted under 35 U.S.C. 154(b) by 0 days.

(21) Appl. No.: 16/652,543

(22) PCT Filed: Oct. 24, 2018

(86) PCT No.: PCT/NO2018/050254

§ 371 (c)(1),
(2) Date: Mar. 31, 2020

(87) PCT Pub. No.: WO2019/083374

PCT Pub. Date: May 2, 2019

(65) Prior Publication Data

US 2020/0247648 A1 Aug. 6, 2020

(30) Foreign Application Priority Data

Oct. 25, 2017 (NO) ..... 20171705

(51) Int. Cl.
*E21B 19/14* (2006.01)
*E21B 15/02* (2006.01)
(Continued)

(52) U.S. Cl.
CPC ..... *B66C 23/201* (2013.01); *B66C 6/00* (2013.01); *B66C 7/02* (2013.01); *E02B 17/021* (2013.01); *E21B 19/00* (2013.01); *E21B 15/003* (2013.01)

(58) Field of Classification Search
CPC ..... B66C 23/201; B66C 6/00; B66C 7/02; B66C 23/18; B66C 23/24; B66C 19/00;
(Continued)

(56) References Cited

U.S. PATENT DOCUMENTS 3,675,786 A * 7/1972 Wilson ..... B66C 17/00 212/316
4,044,858 A * 8/1977 Vikre ..... E02B 17/0034 182/150
(Continued)

FOREIGN PATENT DOCUMENTS

| | | |
|---|---|---|
| KR | 20160039847 | 4/2016 |
| NO | 20171677 | 10/2018 |
| WO | 2016178576 | 11/2016 |

OTHER PUBLICATIONS

Norwegian Search Report for No. 20171705, dated Dec. 13, 2018.
(Continued)

*Primary Examiner* — Edwin J Toledo-Duran
(74) *Attorney, Agent, or Firm* — Andrus Intellectual Property Law, LLP

(57) ABSTRACT

A crane system is for a cantilever belonging to a jack-up rig. The crane system has a crane with a suspension member, the suspension member being arranged over the crane. A skid beam is attached to a lower portion of the cantilever, the skid beam being displaceably connected to a plurality of slides arranged on the jack-up rig, the crane hanging on the skid beam. A method is for using the crane system.

20 Claims, 4 Drawing Sheets

(51) Int. Cl.

| | |
|---|---|
| ***B66C 23/20*** | (2006.01) |
| ***B66C 6/00*** | (2006.01) |
| ***B66C 7/02*** | (2006.01) |
| ***E02B 17/02*** | (2006.01) |
| ***E21B 19/00*** | (2006.01) |
| *E21B 15/00* | (2006.01) |

(58) Field of Classification Search
CPC ..... E02B 17/021; E02B 17/00; E02B 17/80; E21B 19/00; E21B 15/003; E21B 15/00; E21B 19/002; E21B 19/14; E21B 19/087; E21B 19/143; E21B 15/02; B63B 35/44
See application file for complete search history.

(56) References Cited

U.S. PATENT DOCUMENTS 4,144,940 A * 3/1979 Ortemond ..... E21B 15/02 175/9
4,602,894 A * 7/1986 Lorenz ..... E21B 15/003 405/196
6,220,807 B1 * 4/2001 Sorokan ..... E21B 19/155 414/22.55
6,491,174 B1 * 12/2002 Day ..... B66C 23/52 212/253
10,745,983 B2 * 8/2020 Van Der Hoorn ..... E21B 19/22
2003/0106870 A1 * 6/2003 Takehara ..... B66C 19/002 212/312
2006/0180564 A1 8/2006 Keppel
2009/0274543 A1 * 11/2009 Grotherr ..... E21B 19/00 166/85.1
2010/0303586 A1 * 12/2010 Hankins ..... E21B 19/14 414/800
2014/0262504 A1 * 9/2014 Seng ..... E21B 7/12 182/36
2017/0267376 A1 * 9/2017 Benedetto ..... B64F 1/04
2021/0032945 A1 * 2/2021 Van Der Hoorn ..... E21B 15/02

OTHER PUBLICATIONS

International Search Report and the Written Opinion for PCT/NO2018/050254, dated Dec. 12, 2018.
Reply to the Written Opinion for PCT/NO2018/050254, dated Jul. 23, 2019.
Written Opinion for PCT/NO2018/050254, dated Oct. 31, 2019.
International Preliminary Report on Patentability for PCT/NO2018/050254, dated Jan. 14, 2020.
European Search Report for Corresponding European Patent Application No. 18/869,987, dated Jun. 4, 2021.

* cited by examiner

CRANE SYSTEM FOR A CANTILEVER

CROSS-REFERENCE TO RELATED APPLICATIONS

This application is the U.S. national stage application of International Application PCT/N02018/050254, filed Oct. 24, 2018, which international application was published on May 2, 2019, as International Publication WO 2019/083374 in the English language. The International Application claims priority of Norwegian Patent Application No. 20171705, filed Oct. 25, 2017. The international application and Norwegian application are both incorporated herein by reference, in entirety.

In a first aspect, the invention relates to a crane system for a cantilever belonging to a jack-up rig, the crane system comprising a crane with a suspension member. In a second aspect, the invention relates to a method of using the crane system.

BACKGROUND OF THE INVENTION

From the marine petroleum industry, it is known to use a self-elevating unit, referred to as a jack-up rig in the technical language. A jack-up rig comprises a floating hull with a rig floor and several vertical legs that can be moved up or down relative to the hull. By raising the legs, the jack-up rig can be moved by means of a tugboat. In a position of application, the legs are lowered to a seabed. When the legs are anchored to the seabed, the hull may be raised clear of a water surface. A jack-up rig is typically provided with a projecting arm, referred to as a cantilever in the technical language, typically comprising a deck and a derrick.

The cantilever is a self-supporting structure comprising two sliding beams, referred to as skid beams in the technical language. The skid beams are arranged under and on either side of the cantilever in the longitudinal direction of the cantilever, and movably connected to the rig via a plurality of slides. Thereby the cantilever can be moved horizontally on one or two axes relative to the rig.

The cantilever can be moved between a first, projecting position and a second, retracted position. In the second, retracted position, the cantilever is arranged, in the main, over the rig floor of the jack-up rig. The second, retracted position is typical when the rig is in transit or lay-up.

In the first, projecting position, a portion of the cantilever is arranged outside the jack-up rig and usually over an adjacent object, for example a well, a rig, a quay, a vessel or a seabed. In the first, projecting position, there is often a need for various lifting operations below the cantilever.

Today, all lifting operations below the cantilever are cumbersome and time-consuming. For double operations with drilling at a well centre and a wireline operation in one other and adjacent well, separate tower arrangements may be rigged below the cantilever, wherein the wireline is passed from a drum via sheaves on the tower arrangements and down into the well. Such a wireline operation is relevant, for example, for the positioning of a BOP (blowout preventer) in a well and is particularly laborious because the tower arrangement must be moved for every new well.

As an alternative, it is known to arrange a crane on the side of the cantilever, where the crane can be lowered and swung in under the cantilever. An example of such a crane is the GustoMSC SmartCrane. The drawback of this crane is that it is very large, heavy, complex and costly.

Patent document US2006/0180564 discloses a winch adapted for lifting operations below an I-beam belonging to a cantilever on a drill rig. The winch is connected to a trolley. The trolley is arranged on a lower flange of the I-beam, and the trolley can be moved along the I-beam. The work area of the winch is straight below the I-beam, restricted to the portion of the I-beam where the trolley can be moved.

The invention has for its object to remedy or reduce at least one of the drawbacks of the prior art or at least provide a useful alternative to the prior art.

The object is achieved through the features that are specified in the description below and in the claims that follow.

The invention is defined by the independent claims. The dependent claims define advantageous embodiments of the invention.

GENERAL DESCRIPTION OF THE INVENTION

In a first aspect, the invention relates to a crane system for a cantilever belonging to a jack-up rig, the crane system comprising a crane with a suspension member, the suspension member being arranged above the crane, a sliding beam attached to a lower portion of the cantilever, the sliding beam being displaceably connected to a plurality of slides arranged on the jack-up rig, and the crane hanging on the sliding beam.

The sliding beam is known as a skid beam in the technical language. The projecting arm is known as a cantilever in the technical language. The cross-sectional profile of the skid beam may, for example, be shaped like a T or a Y. The skid beam typically includes a flange with a thickness of between 80 and 160 mm and a width of between 500 and 1000 mm. The cross-sectional profile or the flange corresponds with a guide profile on a plurality of slides arranged on the rig. A first pair of slides is typically arranged on the outer portion of the rig floor, and a second pair of slides is typically arranged on an inner portion of the rig floor. The slides may be fixed to the rig floor or laterally movable so that the cantilever may have a biaxial displacement.

Because the cantilever is adapted for displacement, there is generally little or no possibility of arranging a discrete base on the cantilever that will be strong enough to carry a crane. By hanging the crane on the skid beam as described by the invention, the need for a discrete base for the crane on the cantilever is eliminated.

The crane may be fixedly arranged on the skid beam. A fixedly arranged crane can be fixed to the skid beam when the cantilever is in a first, projecting and operative position. A crane fixed to the skid beam may be arranged in the middle of the projecting portion of the skid beam. Thereby the crane may reach a largest possible area under the cantilever. Before the cantilever is to be moved to a second, retracted position above the rig floor, the crane is dismantled, so that the crane and the suspension member will not come into conflict with the jack-up rig. The mounting and dismounting of the crane may be done with a crane arranged on the rig floor.

The crane may be displaceable along a portion of the skid beam. The crane may be connected to the skid beam via the suspension member. When the cantilever is in the first, projecting position, the crane can be moved along a portion of the skid beam extending from the slides on the rig and to the end of the skid beam. Thereby the crane system provides greater flexibility than when the crane is fixed to the skid beam. By the crane being movable along the skid beam, the size and reach of the crane may be made smaller than when the crane is fixed as described above.

The suspension member may be provided with a rolling supporting means resting against the skid beam. The supporting means may be a wheel, a sheave or a belt. The supporting means may have a carrying or a supporting function. In an advantageous embodiment, two wheel pairs may be arranged over the skid beam, two wheel pairs under the skid beam and two wheel pairs on either side of the skid beam. Thereby a stable guiding of the crane, both vertically and horizontally, may be provided.

In an alternative embodiment, the suspension member may comprise a sliding supporting means. The sliding supporting means may comprise a surface with low friction, for example oil-bronze, a composite or a polymaterial. A sliding supporting means may give a simpler supporting structure than a rolling supporting means, but may involve a more complicated device for moving the crane. The suspension member may comprise a combination of rolling and sliding supporting means.

The suspension member may include a driving device arranged to move the crane along a portion of the skid beam. The driving device may comprise a motor. The motor may be hydraulically or electrically operated and may be arranged to drive a wheel or a pinion. The driving device may include a brake and a gear with a pinion, and the driving device may include a moment transmission. In an alternative embodiment, the movement along the skid beam may be brought about with an actuator or a wire pull.

The driving device may include a toothed wheel arranged to engage with a pitch rack. The pitch rack may be fixed to the skid beam or the cantilever. The pitch rack may be a plurality of holes arranged in the skid beam, referred to as slots in the technical language, or a pitch rack with teeth.

In an alternative embodiment, the crane may be moved by means of a winch or an actuator, for example a hydraulic cylinder. A winch or an actuator may be relevant if the crane is first and foremost arranged for use in given positions.

The crane may include a winch. The winch may be arranged on the suspension member. An embodiment like that provides a possibility of carrying out crane operations straight below the skid beam. If one crane with a winch is arranged on each of the two skid beams, the two cranes may jointly perform joint hoisting operations between the skid beams. Such a hoisting operation may include a hoisting yoke.

The crane may include a crane arm, and the crane arm may be movable. The crane arm may be telescopic to increase the reach of the crane. The crane arm may include a joint arranged to provide a vertical movement of the crane arm, referred to as a tilt in the technical language. The vertical movement may be performed by an actuator, for example a hydraulic cylinder. The movable crane arm may include a guide for a wire or a line.

The crane may include a rotary device provided with a vertical axis of rotation. The rotary device may be arranged between the crane and the suspension member. The rotary device can rotate through 360 degrees and it may, for example, comprise a prior-art slewing ring. Alternatively, the rotary device may comprise a shaft. The rotary device may comprise a swivel adapted for transmitting a fluid and a slip ring adapted for transmitting electrical signals and current.

On the first end portion of the skid beam, a skid-beam extension may be arranged, adapted for positioning the crane on the outside of the cantilever and the skid beam. Thereby the cantilever can be moved to the second, retracted position over the rig floor without the crane coming into conflict with the slide or the rig. The second, retracted position is typical when the rig is being raised, lowered or moved.

The skid-beam extension may be non-detachably or detachably arranged. For increased flexibility and reach of the crane, the skid-beam extension may be so dimensioned that the crane can carry out the lifting operation when the crane is positioned on the skid-beam extension.

The crane may be controlled remotely by a crane operator on a floor below the cantilever or from another suitable place. The crane may comprise the following functions: movement forward/back, rotation right/left, winch up/down, telescope out/in and tilt up/down. The crane may comprise more functions, for example a parking lock and a rotation lock.

The crane system may comprise several cranes, and there may be several cranes arranged on one skid beam. If there is one crane arranged on each of the two skid beams, the reach of the crane arms may be so adjusted that the two cranes cover a half each of the area below the cantilever.

In a second aspect, the invention relates to a method of using a crane system connected to a cantilever on a jack-up rig, the cantilever being provided with a skid beam attached to a lower portion of the cantilever and being displaceably connected to a plurality of slides arranged on the jack-up rig, wherein the method comprises the steps of:

providing a crane with a suspension member, the suspension member being arranged over the crane; and suspending the crane under the skid beam by letting the suspension member engage with the skid beam.

The method may further comprise the step of:

displacing the suspension member along a portion of the skid beam.

The method may further comprise the steps of:

arranging the skid-beam extension on a first end portion of the skid beam;

displacing the crane to a position on the skid-beam extension; and moving the cantilever from a first, projecting position to a second, retracted position.

The method may further comprise the steps of:

moving the cantilever from a second, retracted position to a first, projecting position; and moving the crane from the skid-beam extension to a position between the skid-beam extension and the slide.

The method may further comprise the step of performing a hoisting operation with a hoisting yoke connected to two cranes.

The method may further comprise the step of positioning a body over a well and lowering the body into the well.

The method may further comprise the step of performing a hoisting operation over an adjacent installation.

EXEMPLARY EMBODIMENT

In what follows, an example of a preferred embodiment is described, which is visualized in the accompanying drawings, in which.

Figure 1:
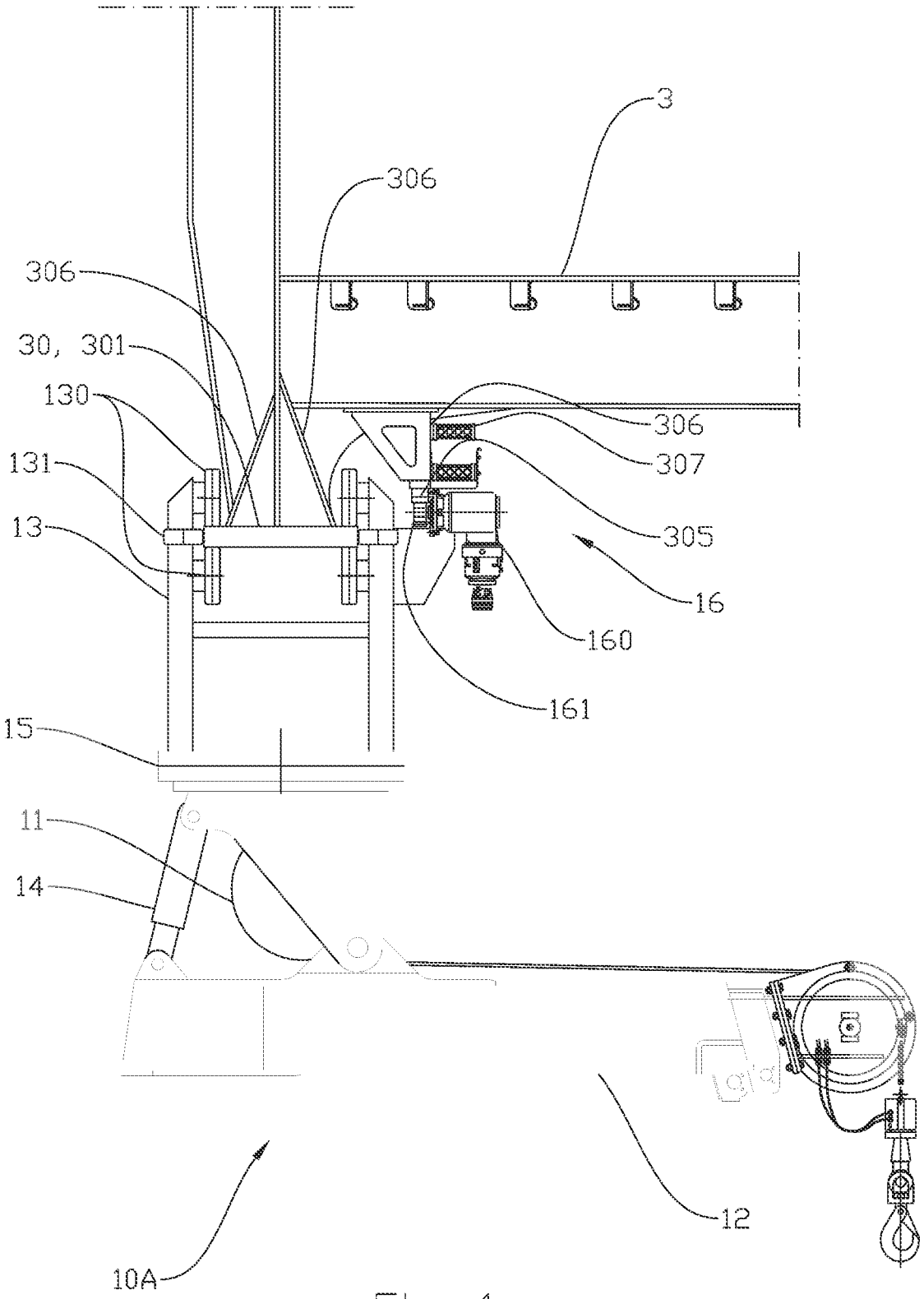
FIG. 1 shows an end view of a crane arranged on a skid beam according to the invention.

FIG. 1 shows an end view of a crane 10A including a suspension member 13 arranged over the crane 10A, the suspension member 13 being displaceably arranged on a skid beam 30. The skid beam 30 is arranged on a lower portion of a cantilever 3. The skid beam 30 comprises a transverse profile 301 and a plurality of braces 306. The skid beam 30 is arranged to slide through several slides 22A, 22B, shown in FIGS. 3-5.

Between the crane 10A and the suspension member 13, a prior-art slewing ring 15 is arranged. The slewing ring 15 comprises a slip ring for the transmission of electrical signals and a slip ring for the transmission of a hydraulic pressure to a winch 11, a cylinder 14 and a telescopic cylinder (not shown).

The suspension member 13 includes supporting means, shown here as a plurality of wheels 130, 131. Four wheels 130 rest supportingly against a top side of the transverse profile 310. On either side of the transverse profile 301, two supporting wheels 131 are arranged, adapted for giving the suspension member 13 a stable guiding sideways.

Figure 4:
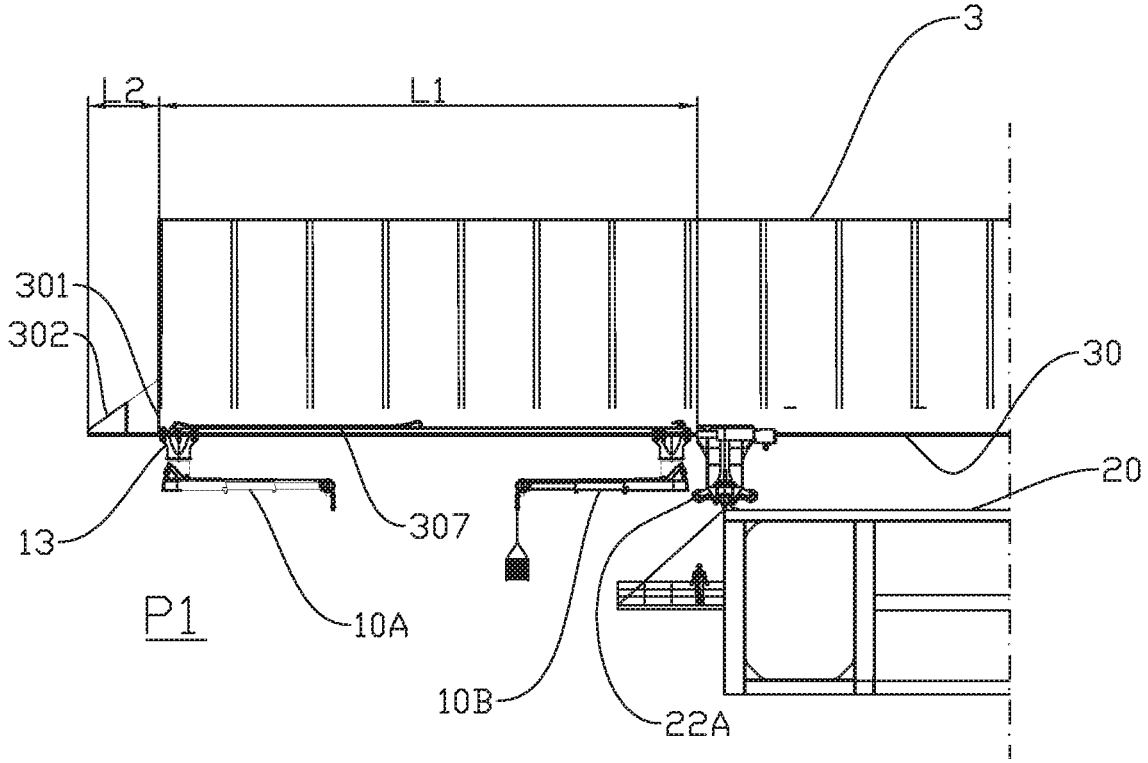
FIG. 4 shows a side view, on a larger scale, of the cantilever and two cranes in an operative position.

The suspension member 13 further includes a driving device 16 comprising a hydraulic motor 160. The motor 160 is provided with a toothed wheel 161 arranged to engage with a pitch rack 305. The pitch rack 305 is attached to the cantilever 3 via a plurality of brackets 306. The brackets 306 are also a base for a cable run 307, comprising a plurality of electrical cables and a plurality of hydraulic hoses arranged for the transfer of current, electrical signals and oil to the crane 10A. The cable run 307 is connected, at a first end portion, to the cantilever 3 and is connected, at its second end portion, to the suspension member 13 as shown in FIG. 4.

The crane 10A comprises a telescopic crane arm 12, a winch 11 and a hydraulic cylinder 14. The crane 10A is provided with the following functions: linear movement for-ward/back, pivot right/left, tilt up/down, telescope out/in, winch cable out/in.

Figure 2:
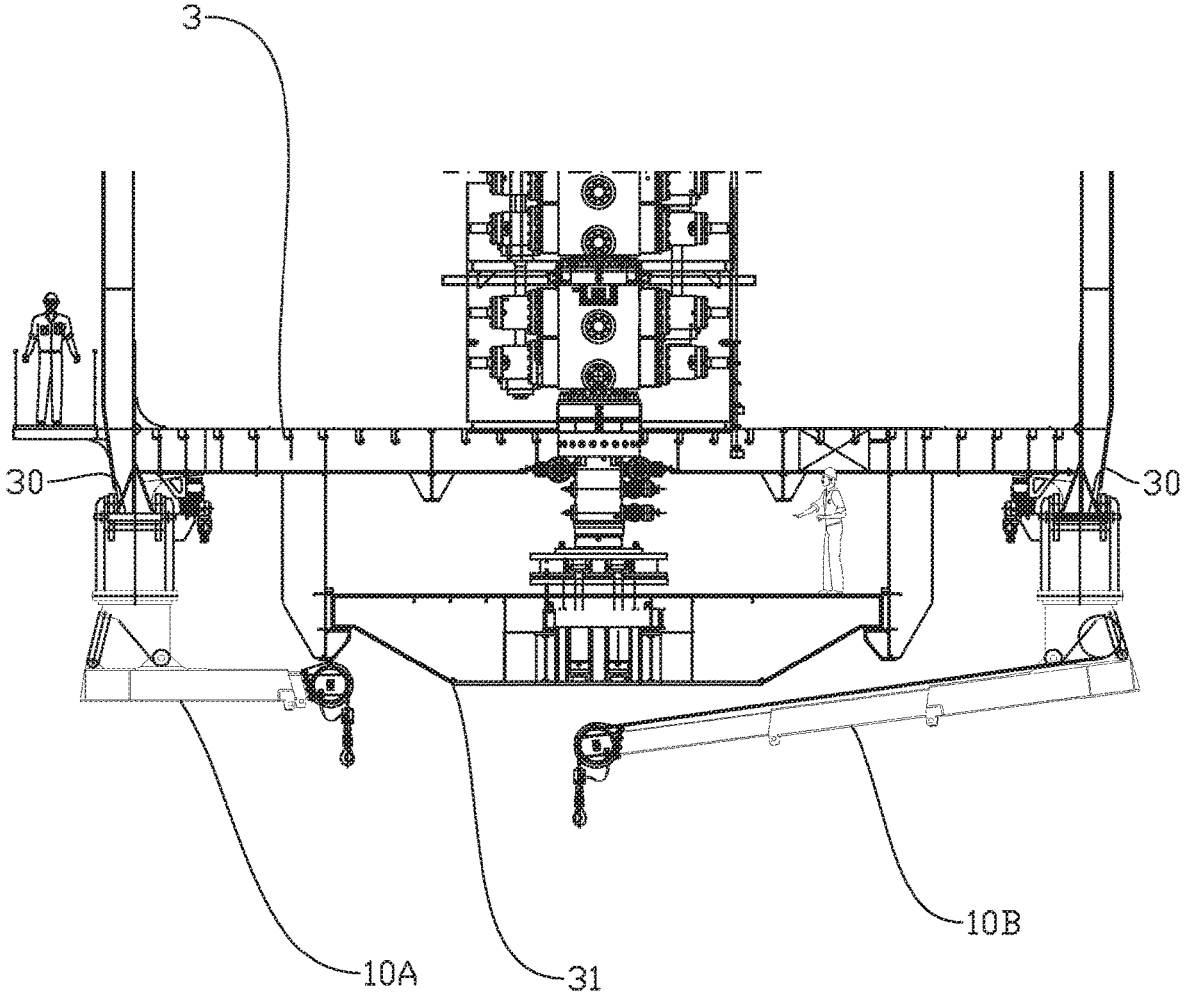
FIG. 2 shows an end view, on a smaller scale, of a crane system comprising two cranes arranged on two skid beams.

FIG. 2 shows an end view, on a smaller scale, of two cranes 10A, 10B arranged on two skid beams 30. The cranes 10A, 10B are shown in two different operational positions. FIG. 2 shows how a crane system 1 according to the invention provides a possibility of crane operations in the entire width of the cantilever 3 without coming into conflict with an intermediate structure 31.

Figure 3:
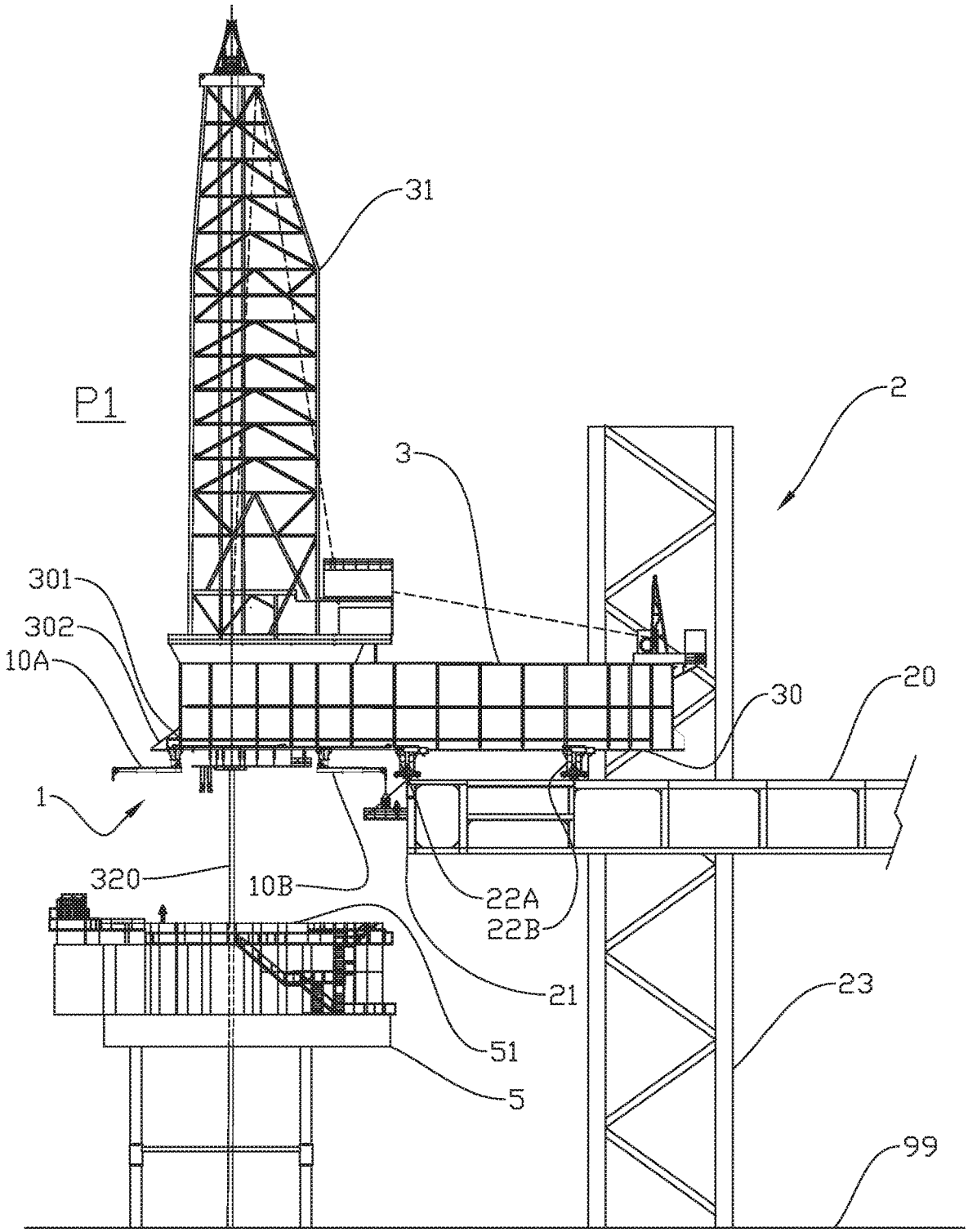
FIG. 3 shows a side view, on a smaller scale, of a jack-up rig comprising a cantilever with two cranes arranged on separate skid beams.

FIG. 3 shows a side view, on a smaller scale, of a jack-up rig 2 including a cantilever 3 with a derrick 31 and a crane system 1 according to the invention. The cantilever 3 is shown in a first, projecting position P1. The cantilever 3 and the derrick 31 are positioned over a jacket rig 5 fixed to the seabed. From the derrick 31 and through the jacket rig 5, a drill string 320 is arranged.

The skid beams 30 are displaceably connected to the jack-up rig 2 via two slides 22A arranged farthest out on a rig floor 20 and two slides arranged inside the rig floor 20. A skid-beam extension 302 is arranged on a first end portion 301 of the skid beam 30.

A first crane 10A is positioned on the skid-beam extension 302 and a second crane 10B is positioned on the skid beam 30. The cranes 10A, 10B are arranged on separate skid beams 30 and adapted for carrying out lifting operations on the jacket rig 5.

By the cantilever 3 being provided with a crane system 1, there is no need for the floor 51 of the jacket rig 5 to have cranes of its own and temporary cranes. This simplifies the lifting operations on the floor 51 of the jacket rig 5 and also increases the safety in that there are no cranes arranged on the floor 51 of the jacket rig 5.

FIG. 4 shows a simplified section, on a larger scale, of the side view of FIG. 3. The cantilever 3 is arranged in the first, projecting position P1, in which a substantial part of the cantilever 3 is outside the floor 20 of the jack-up rig 2. The cranes 10A, 10B can be moved along a portion L1 of the two skid beams 30, between the skid-beam extension 302 and the slide 22A. Two skid-beam extensions 302 are attached to first end portions 301 of the skid beams 30. Thereby the operational distance of the cranes 10A, 10B may have an increase corresponding to the length L2.

Figure 5:
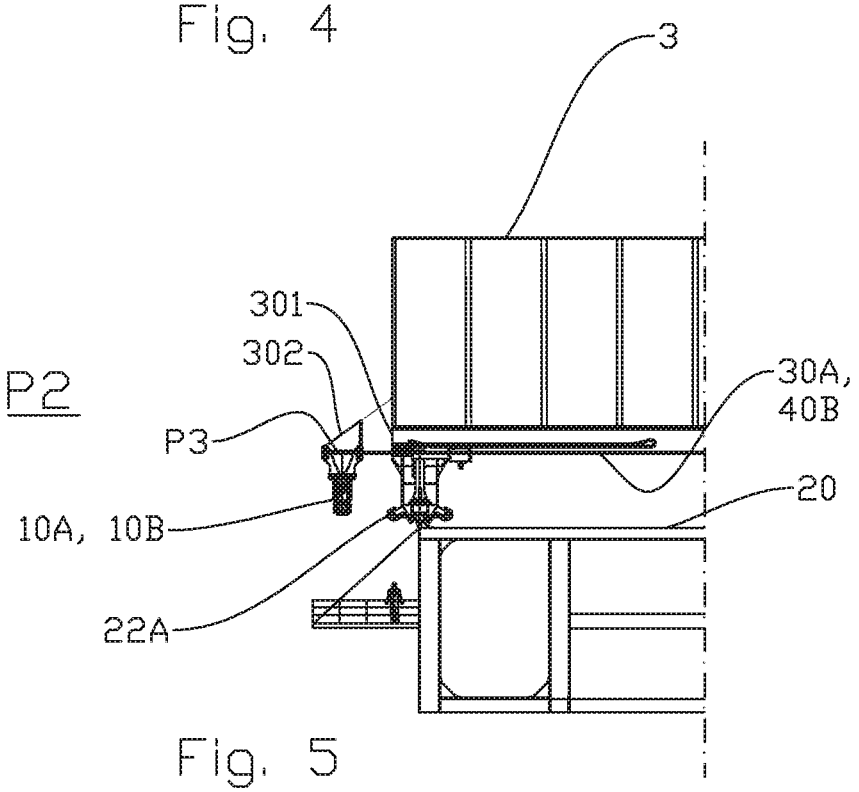
FIG. 5 shows a side view of the cantilever and the cranes in a transit position.

FIG. 5 shows a side view of the cantilever 3 and the crane system 1 in a second, retracted position P2, known in the technical language as a transit position, typical when the jack-up rig 2 is being raised, lowered and moved. In the transit position, the cantilever 3 is positioned over the rig floor 20 as shown in FIG. 5. The cranes 10A, 10B are placed in a position P3 on the skid-beam extensions 302. By the cranes 10A, 10B being positioned on the skid-beam extensions 302 as shown in the figure, the cranes 10A, 10B will not come into conflict with the slide 22A or the rig 2 when the cantilever 3 is in the transit position P2. If the skid-beam extensions 302 have the necessary strength, the cranes 10A, 10B can be used when the cantilever 3 is in the transit position.

It should be noted that all the above-mentioned embodiments illustrate the invention, but do not limit it, and persons skilled in the art may construct many alternative embodiments without departing from the scope of the attached claims. In the claims, reference numbers in brackets are not to be regarded as restrictive.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A crane system for a cantilever belonging to a jack-up rig, the crane system comprising:

a crane with a suspension member, the suspension member being arranged over the crane, two skid beams attached to a lower portion of the cantilever, the two skid beams being displaceably connected to a plurality of slides arranged on the jack-up rig, so that the cantilever is movable relative to the jack-up rig via the two skid beams and the plurality of slides, wherein the crane hangs on a first skid beam only of the two skid beams via the suspension member, such that the crane is repositionable along the first skid beam independently of the second skid beam.

2. The crane system according to claim 1, wherein the crane is displaceable along a portion of the first skid beam.

3. The crane system according to claim 2, wherein the suspension member is provided with a wheel resting on the first skid beam.

4. The crane system according to claim 2, wherein the suspension member includes a driving device arranged to move the crane along a portion of the first skid beam.

5. The crane system according to claim 4, wherein the driving device comprises a toothed wheel arranged to engage with a pitch rack attached to the first skid beam or the cantilever.

6. The crane system according to claim 1, wherein the crane is provided with a winch.

7. The crane system according to claim 1, wherein the crane is provided with a crane arm.

8. The crane system according to claim 1, further comprising a skid beam extension arranged on a first end portion of the first skid beam.

9. A method of using a crane system connected to a cantilever on a jack-up rig, the cantilever being provided with two skid beams which are attached to a lower portion of the cantilever and are displaceably connected to a plurality of slides arranged on the jack-up rig, so that the cantilever is movable relative to the jack-up rig via the two skid beams and the plurality of slides, the method comprising the step of:

providing a crane with a suspension member, the suspension member being arranged over the crane; and suspending the crane under a first skid beam only of the two skid beams by letting the suspension member engage with the first skid beam, the crane being configured to be repositionable along the first skid beam independently of the second skid beam.

10. The method according to claim 9, wherein the method further comprises the step of:

displacing the suspension member along a portion of the first skid beam.

11. The method according to claim 9, wherein the method comprises the further steps of:

arranging a skid-beam extension on a first end portion of the first skid beam;

moving the crane to a position on the skid-beam extension; and moving the cantilever from a first, projecting position into a second, retracted position.

12. The method according to claim 9, wherein the method comprises the further steps of:

arranging a skid-beam extension on a first end portion of the first skid beam;

moving the cantilever from a second, retracted position to the first, projecting position; and moving the crane from the skid-beam extension to a position between the skid-beam extension and a slide in the plurality of slides.

13. The method according to claim 9, wherein the crane is a first crane and the method comprises the further steps of:

arranging a second crane in the crane system; and—performing a hoisting operation with a hoisting yoke connected to the first crane and the second crane.

14. The method according to claim 9, wherein the method comprises the further step of:

using the crane to position a body over a well and lower the body into the well.

15. The method according to claim 9, wherein the method comprises the further step of:

performing a hoisting operation over an adjacent installation.

16. The crane system according to claim 3, wherein the suspension member includes a driving device arranged to move the crane along a portion of the first skid beam.

17. The method according to claim 10, wherein the method comprises the further steps of:

arranging a skid-beam extension on a first end portion of the first skid beam;

moving the crane to a position on the skid-beam extension; and moving the cantilever from a first, projecting position into a second, retracted position.

18. The crane system according to claim 8, wherein the skid-beam extension is configured to increase an operational distance of the crane corresponding to a length of the skid beam extension.

19. A crane system for attachment to a jack-up rig having a cantilever with a first skid beam and a second skid beam attached to a lower portion of the cantilever, the first and second skid beams are coupled to a plurality of slides arranged on the jack-up rig such that the cantilever is movable relative to the jack-up rig via the first and second skid beams and the plurality of slides, the crane system comprising:

a crane with a suspension member coupled to only the first skid beam of the cantilever such that:

the crane hangs on only the first skid beam of the cantilever via the suspension member;

the crane is repositionable along the first skid beam independently of the second skid beam; and the crane is moveable along the first skid beam of the cantilever without moving into conflict with an intermediate structure or a tubular string positioned between the first and second skid beams.

20. The crane system according to claim 19, further comprising a skid beam extension configured to be arranged on an end of the first skid beam;

wherein the skid beam extension aligns with the first skid beam; and wherein the crane is repositionable into a position along the skid beam extension such that when the cantilever is in a transit position the crane does not come into conflict with the jack-up rig.

* * * * *